US010381779B2

(12) United States Patent
Zhou et al.

(10) Patent No.: US 10,381,779 B2
(45) Date of Patent: Aug. 13, 2019

(54) ELECTRICAL CONNECTOR WITH A GUIDE SHELL

(71) Applicant: LOTES CO., LTD, Keelung (TW)

(72) Inventors: Kai Quan Zhou, Keelung (TW); Jun Wang, Keelung (TW)

(73) Assignee: LOTES CO., LTD, Keelung (TW)

( * ) Notice: Subject to any disclaimer, the term of this patent is extended or adjusted under 35 U.S.C. 154(b) by 3 days.

(21) Appl. No.: 15/864,222

(22) Filed: Jan. 8, 2018

(65) Prior Publication Data

US 2018/0205177 A1 Jul. 19, 2018

(30) Foreign Application Priority Data

Jan. 17, 2017 (CN) ..... 2017 2 0052370 U

(51) Int. Cl.
*H01R 13/631* (2006.01)
*H01R 12/71* (2011.01)
(Continued)

(52) U.S. Cl.
CPC ..... *H01R 13/631* (2013.01); *H01R 12/716* (2013.01); *H01R 12/79* (2013.01);
(Continued)

(58) Field of Classification Search
CPC .... H01R 13/631; H01R 12/716; H01R 12/79; H01R 13/436; H01R 13/5213; H01R 13/6272; H01R 13/6581; H01R 13/629; H01R 13/6587; H01R 24/60
USPC ..... 439/78, 607.04, 607.13, 607.14, 607.31, 439/607.35, 636, 637, 676, 733.1, 374, 439/607.53, 377
See application file for complete search history.

(56) References Cited

U.S. PATENT DOCUMENTS 6,168,468 B1 * 1/2001 Zhu ..... H01R 13/658 439/607.01
6,309,247 B1 * 10/2001 Wang ..... H01R 13/5213 439/135
(Continued)

FOREIGN PATENT DOCUMENTS

CN 201112824 Y 9/2008
CN 205212036 U 5/2016
CN 205693075 U 11/2016

*Primary Examiner* — Travis S Chambers
(74) *Attorney, Agent, or Firm* — Locke Lord LLP; Tim Tingkang Xia, Esq.

(57) ABSTRACT

An electrical connector includes an insulating body having a base portion, which includes a mating chamber enclosed by a top plate, a bottom plate and two side plates. The mating chamber allows a insertion portion of a mating connector to insert backward therein. The top and bottom plates are provided with multiple accommodating grooves. A projection protrudes from each side plate. The projection has a highest point higher than the mating chamber, and a lowest point lower than the mating chamber. Multiple terminals are correspondingly accommodated in the accommodating grooves. A shielding shell has a top wall and two side walls. A mating port is enclosed by the top wall and front ends of the two side walls and located in front of the projection, and is larger than the mating chamber. Each side wall is respectively and correspondingly provided with a fitting portion to fit with the projection.

20 Claims, 11 Drawing Sheets

(51) Int. Cl.

| | |
|---|---|
| ***H01R 12/79*** | (2011.01) |
| ***H01R 13/6581*** | (2011.01) |
| ***H01R 13/627*** | (2006.01) |
| ***H01R 13/436*** | (2006.01) |
| ***H01R 13/6594*** | (2011.01) |
| *H01R 13/52* | (2006.01) |
| *H01R 12/70* | (2011.01) |

(52) U.S. Cl.
CPC ..... *H01R 13/436* (2013.01); *H01R 13/6272* (2013.01); *H01R 13/6581* (2013.01); *H01R 13/6594* (2013.01); *H01R 12/7052* (2013.01); *H01R 13/5213* (2013.01)

(56) References Cited

U.S. PATENT DOCUMENTS

| | | | | |
|---|---|---|---|---|
| 7,226,314 | B2 | 6/2007 | Lang et al. | |
| 7,445,502 | B2 * | 11/2008 | Zhang | H01R 13/658 439/607.01 |
| 7,997,922 | B2 * | 8/2011 | Dawiedczyk | H01R 13/6275 439/357 |
| 2010/0144188 | A1 * | 6/2010 | Allwood | H01R 13/506 439/404 |
| 2014/0245606 | A1 * | 9/2014 | Lin | H01R 13/6581 29/884 |

* cited by examiner

ELECTRICAL CONNECTOR WITH A GUIDE SHELL

CROSS-REFERENCE TO RELATED PATENT APPLICATION

This application claims priority to and the benefit of, pursuant to 35 U.S.C. § 119(a), patent application Serial No. CN201720052370.9 filed in China on Jan. 17, 2017. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and in particular to an electrical connector that may prevent a mating connector from scratching an insulating body.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Generally, in the mating of two connectors, there is no preferable guiding device designed between a receptacle and a plug. Therefore, a lot time is spent on alignment in a mating process. If the plug deviates or is misplaced by a small angle, the socket cannot mate with the plug smoothly, which may even cause damages to the connector structure.

U.S. Pat. No. 7,226,314 discloses a receptacle connector that has an insulative body and a guide shell. The insulative body contains a mating groove that is hollowed backward from a front end surface of the insulative body. Multiple terminal grooves are provided at two opposite sidewalls of the mating groove to accommodate multiple terminals. The guide shell comprises an accommodating space formed by an upper plate and two partition plates. The upper plate bends toward the accommodating space to form two elastic arms, and the guide shell is located at a front end of an opening of the mating groove of the insulative body, so that the insulative body and the guide shell are assembled to form the receptacle connector.

In the patent, the guide shell is fixed at the front end of the opening of the mating groove of the insulative body. When the receptacle connector mates with a plug connector, the plug connector is guided by the elastic arms, and may efficiently provide quick positioning of upper and lower vertical positions, so that a tongue of the plug connector is accurately inserted in the mating groove, and the plug connector is accommodated in the accommodating space of the guide shell, thereby reducing time wasted when alignment cannot be performed accurately in mating of the connector. However, in the patent, when the tongue of the plug connector mates with the receptacle connector, although alignment in a vertical direction can be accurately provided, a solution regarding alignment in a horizontal direction is not provided. Therefore, the connector is not accurately aligned in the horizontal direction in mating of the connector. As a result, the tongue may easily deviate to the left or the right. Because the tongue is not accurately aligned, the insulative body of the receptacle connector may be easily scratched, causing damages to the insulative body, and further affecting service life of the receptacle connector.

Therefore, a heretofore unaddressed need to design a new electrical connector exists in the art to address the aforementioned deficiencies and inadequacies.

SUMMARY

An objective of the present invention is to provide an electrical connector that may prevent a mating connector from scratching an insulating body.

To achieve the foregoing objective, the present invention adopts the following technical solutions.

An electrical connector electrically connected to a mating connector is provided, including: an insulating body having a base portion, wherein the base portion comprises a mating chamber enclosed by a top plate, a bottom plate and two side plates, the mating chamber is configured for a insertion portion of the mating connector to insert backward therein, the top plate and the bottom plate are respectively provided with a plurality of accommodating grooves, the accommodating grooves communicate with the mating chamber, an outer surface of each of the side plates is outward protrudingly provided with a projection, a highest point of the projection is higher than the mating chamber, and a lowest point of the projection is lower than the mating chamber; a plurality of terminals, correspondingly accommodated in the accommodating grooves; and a shielding shell, having a top wall and two opposite side walls formed by bending downward from two opposite sides of the top wall, wherein a mating port is enclosed by the top wall and front ends of the two side walls and located in front of the projection, the mating port is larger than the mating chamber, the top wall shields the top plate and at least partially protrudes forward from the top plate, each of the side walls shields a corresponding one of the side plates and at least partially protrudes forward from the corresponding one of the side plates, and each of the side walls is respectively and correspondingly provided with a fitting portion to fit with the projection.

In certain embodiments, the fitting portion is formed by protruding outward from an outer surface of each of the side walls, and wraps the projection.

In certain embodiments, a front end of the projection is flush with a front end of the top plate, a front end of the mating chamber has a guide chamfer, and the guide chamfer extends to the front end of the projection.

In certain embodiments, a frame portion extends backward from the base portion, an upper surface of the frame portion is higher than the top plate, the top wall backward abuts a front end of the frame portion, and a surface of the projection is flush with a side surface of the frame portion.

In certain embodiments, an abutting portion is connected to a rear end of the projection, and the side wall backward abuts the abutting portion.

In certain embodiments, the top wall has two side portions and a protruding portion located between the two side portions, the protruding portion has a buckling hole for latching the mating connector, the two side portions are upward protrudingly provided with two ribs located at two opposite sides of the protruding portion, and the ribs are located in front of the top plate.

In certain embodiments, the top wall is provided with two first through holes located right behind the two ribs, and the insulating body is provided with two first engaging blocks engaged with the first through holes respectively.

In certain embodiments, the shielding shell further has a bottom wall provided to be opposite to the top wall, the bottom wall is provided with two second through holes, the insulating body is provided with two second engaging blocks engaged with the second through holes respectively, and projections of the two second through holes onto the top wall are located between the two first through holes.

In certain embodiments, the shielding shell further has a bottom wall provided to be opposite to the top wall, a seam portion is formed on the bottom wall to fix the shielding shell after the shielding shell is bent, and a projection of one of the first through holes onto the bottom wall overlaps the seam portion.

In certain embodiments, the insulating body is protrudingly provided with two installation portions installed in two installation holes of a circuit board, one of the two installation portions is rhombic and the other of the two installation portions is cylindrical, a side edge of the insulating body is provided with a groove extending to one of the installation portions, and a gap distance exists between an edge of the one of the installation portions and the side edge of the insulating body.

In certain embodiments, the top wall is provided with a buckling hole for latching the mating connector, a dustproof cover is provided to cover the mating port, the dustproof cover is provided with a buckling portion, and the buckling hole is used to buckle one of the buckling portion and the mating connector.

In certain embodiments, the front end of each of the side walls is provided with a notch, and each of two opposite sides of the dustproof cover is protrudingly provided with a handgrip portion right in front of the notch and laterally protrudes out of the notch.

In certain embodiments, the shielding shell further has a bottom wall provided to be opposite to the top wall, and the dustproof cover is made of plastic and is provided with four positioning posts respectively abutting four bending locations between the side walls, the top wall and the bottom wall.

Compared with the related art, the electrical connector according to certain embodiments of the present invention has the following beneficial effects.

A projection is protrudingly provided outward from the outer surface of each of the side plates of the insulating body. The highest point of the projection is higher than the mating chamber, and the lowest point of the projection is lower than the mating chamber. Further, each side wall of the shielding shell is respectively and correspondingly provided with a fitting portion to fit with the projection. Therefore, the strength of the side plates is improved, and scratches and damages caused to the side plates due to inaccurate alignment of the insertion portion of the mating connector may be reduced efficiently, thereby improving service life of the electrical connector, and enabling the electrical connector to better meet requirements of users.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
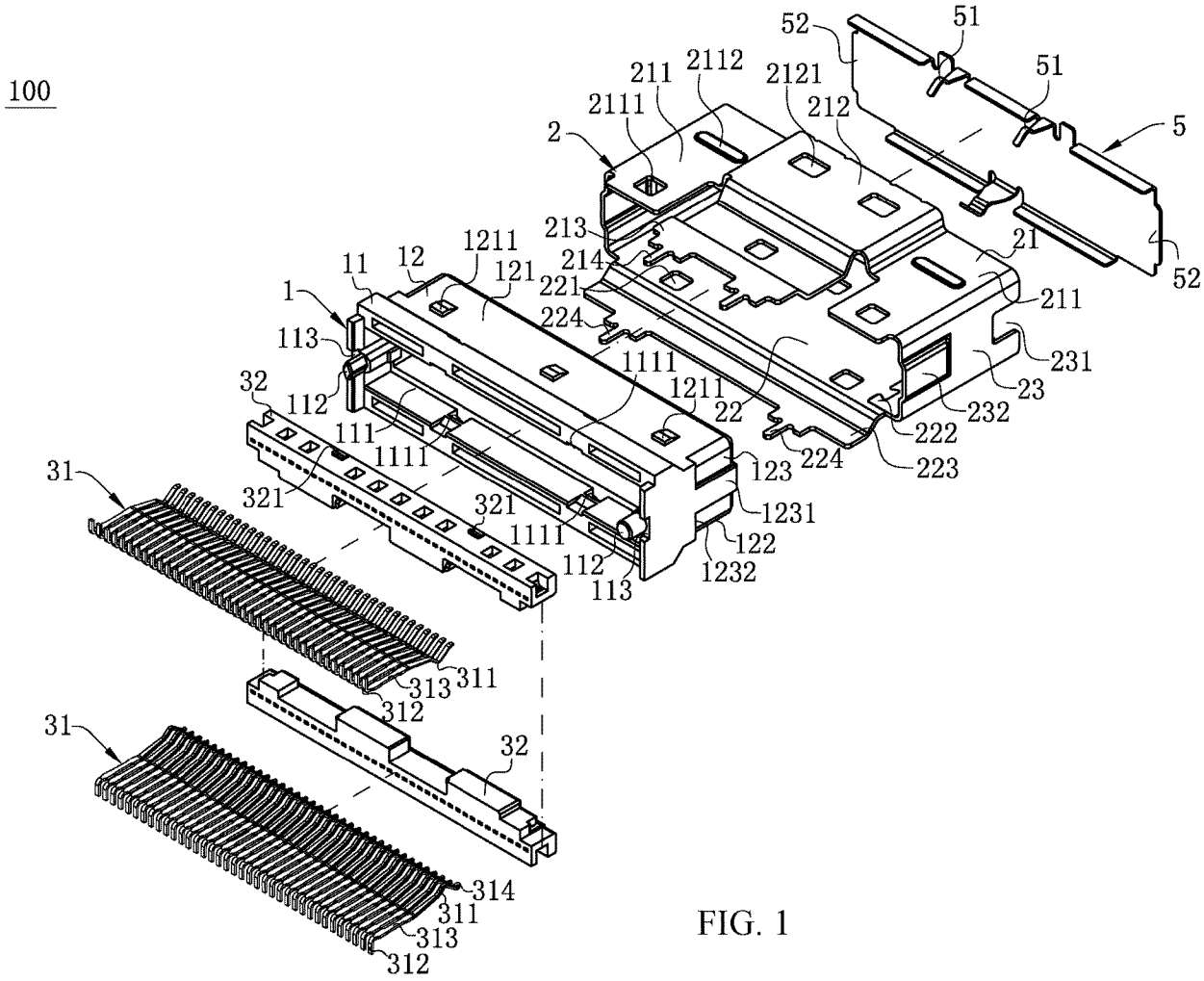
FIG. 1 is a perspective exploded view of an electrical connector according to certain embodiments of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-11. In accordance with the purposes of this invention, as embodied and broadly described herein, this invention, in one aspect, relates to an electrical connector.

Figure 3:
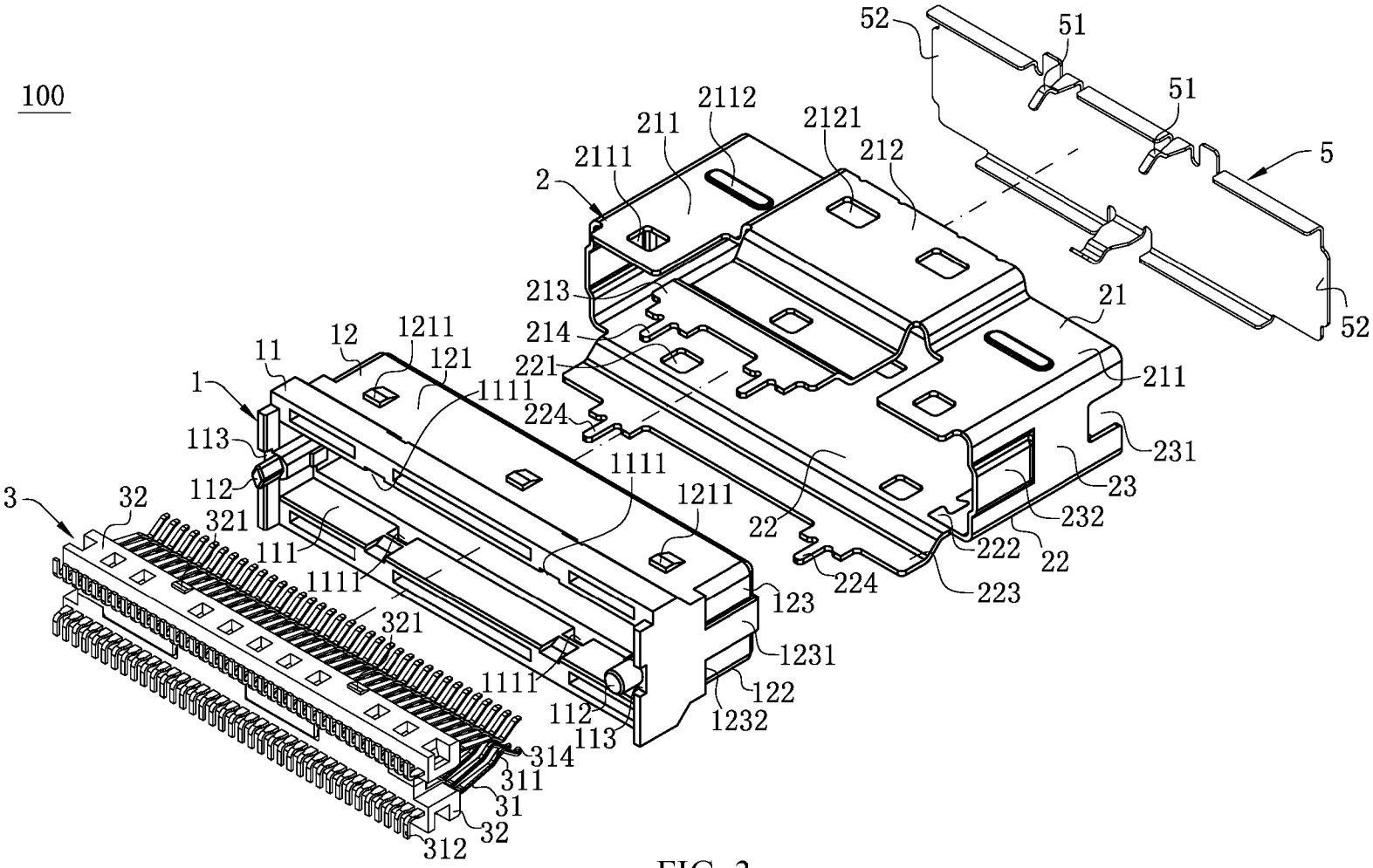
FIG. 3 is a schematic view of two terminal modules in FIG. 2 being assembled.
Figure 4:
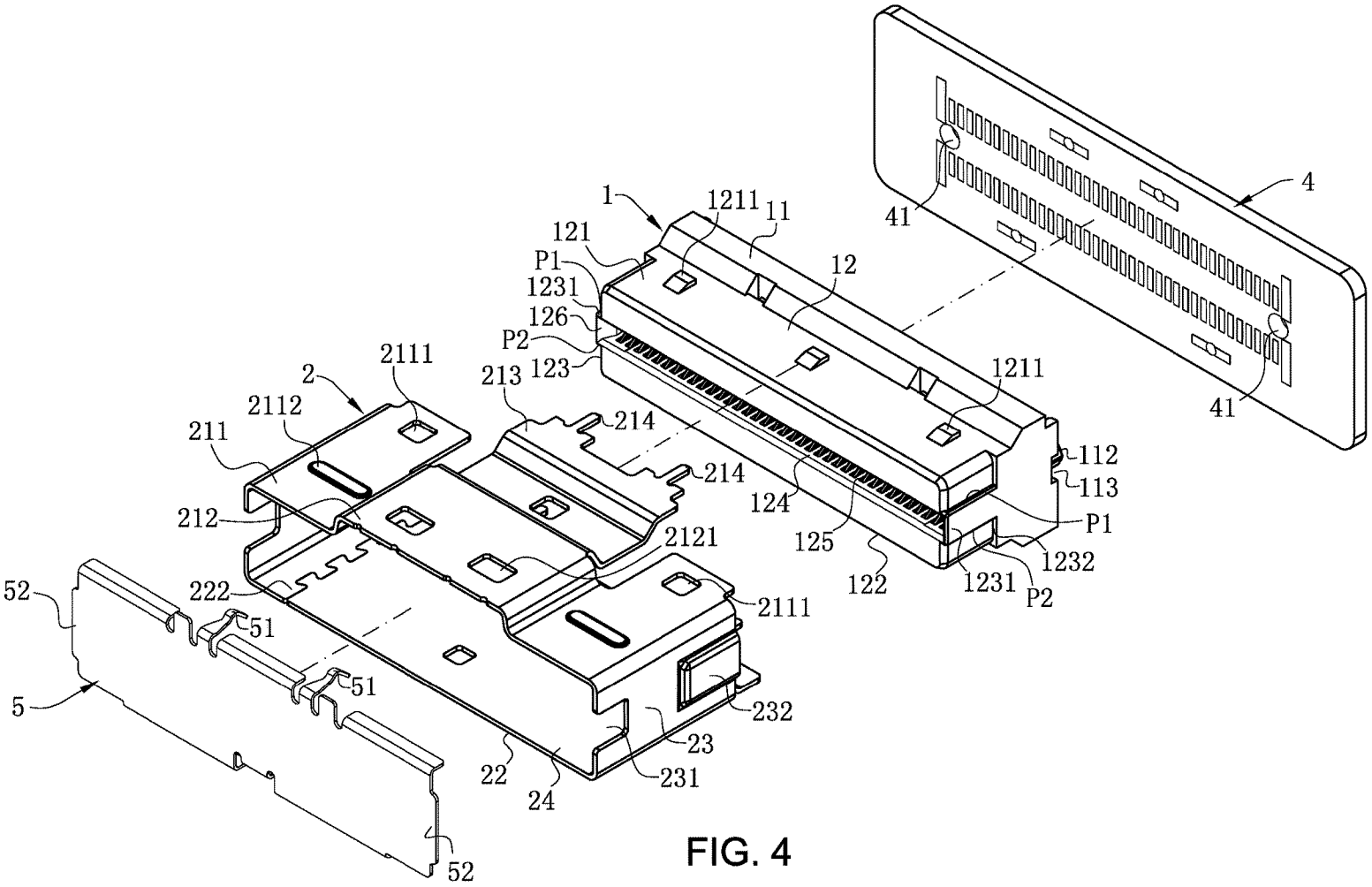
FIG. 4 is a schematic view of FIG. 3 being rotated for 180°.
Figure 8:
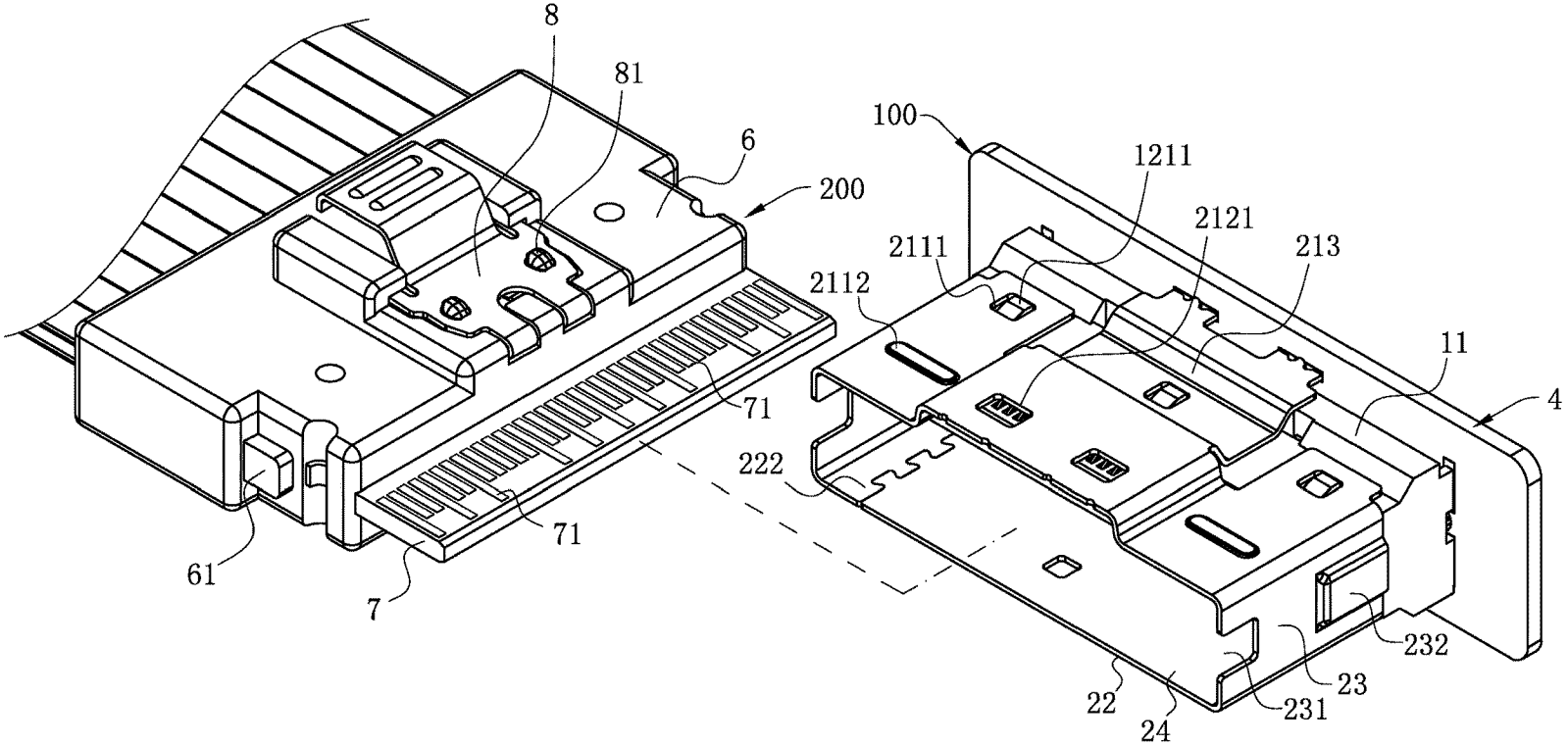
FIG. 8 is a schematic view of an electrical connector before being mated with a mating connector.

As shown in FIG. 3, FIG. 4, and FIG. 8, an electrical connector 100 according to certain embodiments of the present invention is configured to be matched with an insertion portion 7 of a mating connector 200, and includes: an insulating body 1, two terminal modules 3 installed in the insulating body 1, and a shielding shell 2 covering the insulating body 1.

As shown in FIG. 4, the insulating body 1 is in an elongated shape. The insulating body 1 has a frame portion 11 and a base portion 12 extending forward from the frame portion 11. The base portion 12 is provided with a mating chamber 124 enclosed by a top plate 121, a bottom plate 122 and two side plates 123. The mating chamber 124 passes through the base portion 12, and allows the insertion portion 7 to insert therein. An upper surface of the frame portion 11 is higher than the top plate 121, and a lower surface of the frame portion 11 is lower than the bottom plate 122. The top plate 121 and the bottom plate 122 are provided with multiple accommodating grooves 125 that are symmetrically disposed in an upper row and a lower row, and each of the accommodating grooves 125 communicates with the mating chamber 124.

As shown in FIG. 4, a projection 1231 protrudes outward from an outer surface of each of the side plates 123. The projections 1231 are symmetrically disposed in a manner of an upper structure and a lower structure with respect to the mating chamber 124. A highest point P1 of the projection 1231 is higher than the mating chamber 124, and a lowest point P2 of the projection 1231 is lower than the mating chamber 124. A side surface of the projection 1231 is flush with a side surface of the frame portion 11. A front end of the projection 1231 is flush with a front end of the top plate 121. A front end of the mating chamber 124 has a guide chamfer 126 extending to the front end of the projection 1231. Each of the side plates 123 of the base portion 12 is further provided with an abutting portion 1232 connected to a rear end of the projection 1231.

As shown in FIG. 4 to FIG. 7, the shielding shell 2 is made of a metal material, and is formed by an enclosure of a top wall 21, a bottom wall 22 and two side walls 23. The top wall 21 shields the top plate 121 and at least partially protrudes forward from the top plate 121. The bottom wall 22 shields the bottom plate 122 and at least partially protrudes forward from the bottom plate 122. Each of the side walls 23 shields a corresponding one of the side plates 123 and at least partially protrudes forward from the corresponding one of the side plates 123. The top wall 21 backward abuts a front end of the frame portion 11. The side wall 23 backward abuts the abutting portion 1232. A front end of the shielding shell 2 has a mating port 24 that is at front of the projection 1231. A width of the mating port 24 is greater than that of the mating chamber 124, and a length of the mating port 24 is greater than that of the mating chamber 124. Therefore, when the insertion portion 7 is inserted in the mating port 24, there is a gap between the insertion portion 7 and the mating port 24. As a result, the insertion portion 7 is easily obliquely inserted because the insertion portion 7 is not accurately aligned, thereby causing scratches and damages to the side plate 123. A front end of each of the side walls 23 is provided with a rectangular notch 231. A fitting portion 232 is formed by protruding outward from a rear end of each of the side walls 23. The fitting portion 232 wraps the projection 1231. In other embodiments, the fitting portion 232 may also fasten the projection 1231. For example, the fitting portion 232 is a breach hollowed forward from a rear end of each of the side walls 23. The top wall 21 has two side portions 211 and a protruding portion 212 located between the two side portions 211. Each of the side portions 211 is provided with a first through hole 2111. The top plate 121 of the insulating body 1 is correspondingly provided with two first engaging blocks 1211 engaged with the first through holes 2111 respectively. The bottom wall 22 is provided with two second through holes 221. The bottom plate 122 of the insulating body 1 is correspondingly provided with two second engaging blocks 1221 engaged with the second through holes 221 respectively. Moreover, projections of the two second through holes 221 onto the top wall 21 are located between the two first through holes 2111. A seam portion 222 is further formed on the bottom wall 22 to fix the shielding shell 2 after the shielding shell 2 is bent, and a projection of one of the first through holes 2111 onto the bottom wall 22 overlaps the seam portion 222.

Figure 7:
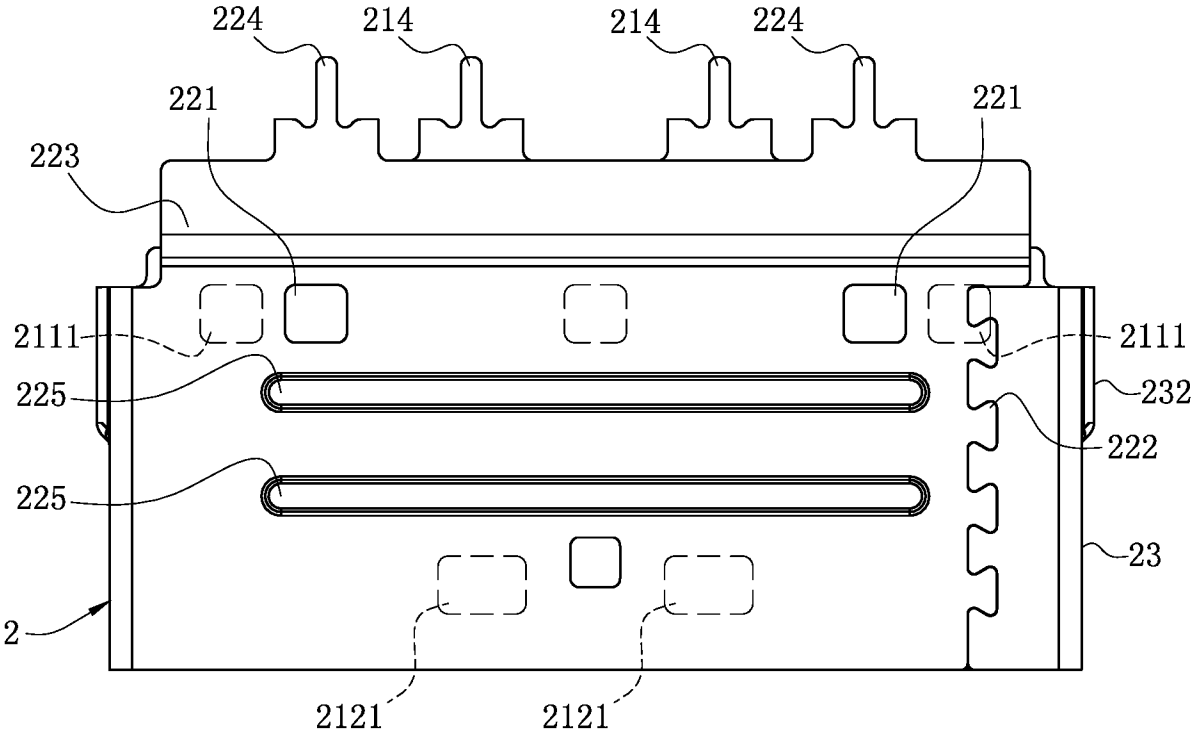
FIG. 7 is a top view of a shielding shell in FIG. 1.

As shown in FIG. 4 to FIG. 7, a first abutting portion 213 is formed by bending from a rear end of the protruding portion 212. The first abutting portion 213 abuts the base portion 12 and the frame portion 11. A pair of first pins 214 further extends backward from a rear end of the first abutting portion 213. The first pins 214 are dip-soldered to a circuit board 4. The protruding portion 212 further has at least one buckling hole 2121 for latching the mating connector 200. In this embodiment, the protruding portion 212 has two buckling holes 2121. A second abutting portion 223 is formed by bending from a rear end of the bottom wall 22. The second abutting portion 223 abuts the frame portion 11. A pair of second pins 224 extends backward from the second abutting portion 223. The second pins 224 are also dip-soldered to the circuit board 4. The first pins 214 are located between the second pins 224 along a transverse direction, and the transverse direction is the length direction of the mating port 24 (i.e., a horizontal direction as shown in FIG. 7). Two ribs 2112 protrude upward from the two side portions 211. The two ribs 2112 are located at two opposite sides of the protruding portion 212, and are located in front of the top plate 121 and right in front of the first through holes 2111. The ribs 2112 are configured to enhance strength of a suspended portion of the side portions 211 located in front of the top plate 121. Two bars 225 are protrudingly provided downward from the bottom wall 22. One of the bars 225 is located in front of the bottom plate 122. The one of the bars 225 is configured to enhance strength of a suspended portion of the bottom wall 22 extending out front of the bottom plate 122.

Figure 2:
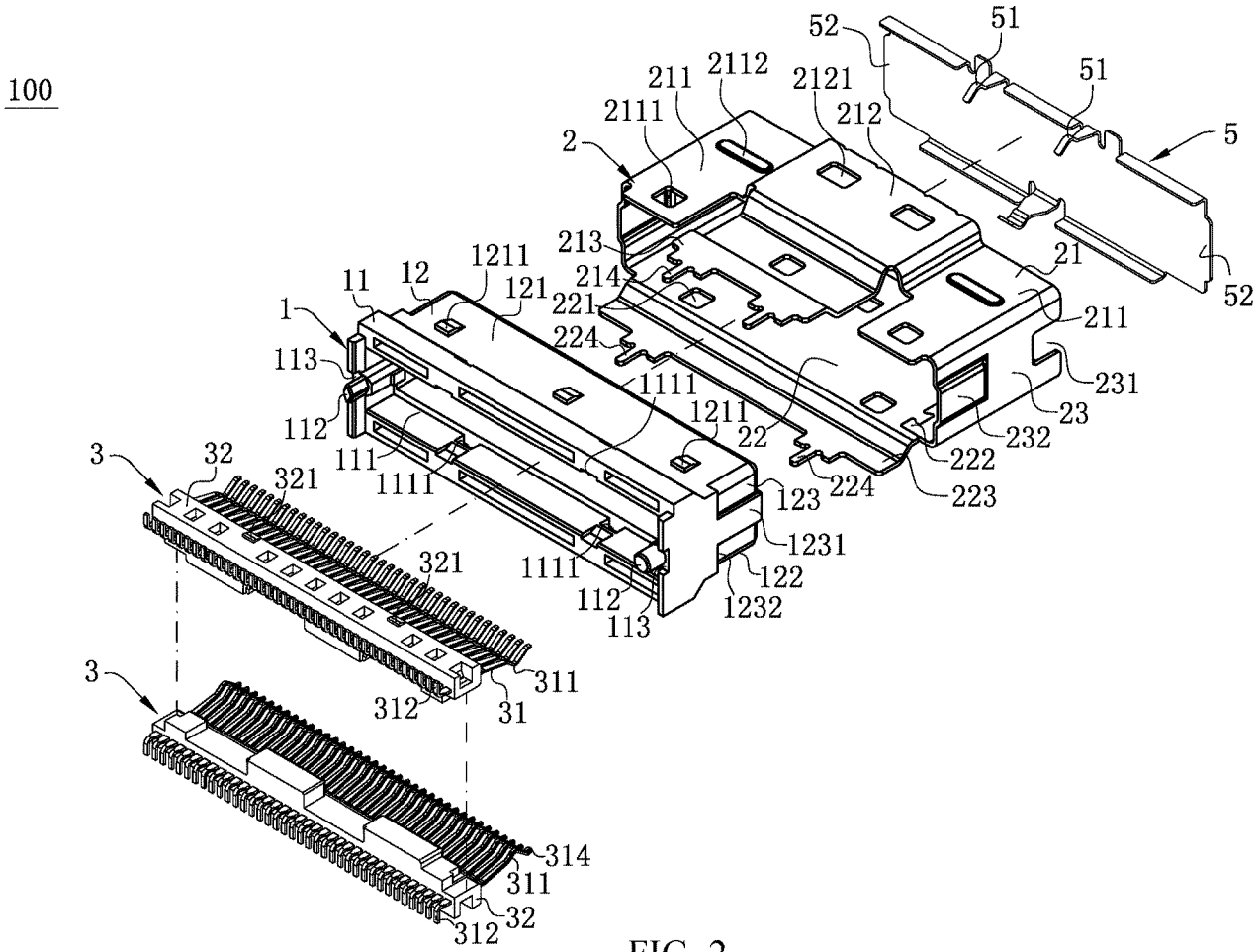
FIG. 2 is a schematic view of a terminal in FIG. 1 being embedded in an insulating block.

As shown in FIG. 1 to FIG. 3, each of the terminal modules 3 includes a row of terminals 31 and an insulating block 32 embedded with the terminals 31. The frame portion 11 is provided with an accommodating chamber 111 that is configured to accommodate the terminal modules 3. The accommodating chamber 111 communicates with the mating chamber 124. An upper side and a lower side of the accommodating chamber 111 are respectively provided with two buckling grooves 1111. The insulating block 32 is provided with two buckling blocks 321 that latch and fit with the two buckling grooves 1111 at the upper side or the lower side of the accommodating chamber 111. Two installation portions 112 protrude backward from a bottom portion of the frame portion 11. The two installation portions 112 are installed in two installation holes 41 of the circuit board 4, and the two installation portions 112 are provided at an inner surface of the accommodating chamber 111. The two installation portions 112 have different shapes, where one is rhombic and the other one is cylindrical. Each of the two side edges of the frame portion 11 is provided with a groove 113 that extends to a corresponding one of the installation portions 112. The grooves 113 are configured to automatically and mechanically direct the insulating body 1. There is a gap distance between an edge of each installation portion 112 and the corresponding side edge of the frame portion 11.

As shown in FIG. 1 to FIG. 4, each terminal 31 is correspondingly accommodated in the accommodating groove 125. Each terminal 31 has a contact portion 311, a rear portion 312, and a main body portion 313 connected to the contact portion 311 and the rear portion 312. The rear portion 312 extends out from the frame portion 11, and is soldered to the circuit board 4 by SMT (surface mount technology). The main body portion 313 is fixed in the insulating block 32. The contact portion 311 enters the mating chamber 124 to mate with the mating connector 200. Two opposite sides of a portion of the terminal 31 extending out from a front of the insulating block 32 have chamfers 314. The chamfers 314 provide guiding functions, and may efficiently prevent damages to the terminal 31 due to the insertion portion 7 being obliquely inserted.

As shown in FIG. 1 to FIG. 3, when the electrical connector 100 according to the embodiment of the present invention is assembled, multiple terminals 31 are embedded in two insulating blocks 32 to form two terminal modules 3. After being assembled, the two terminal modules 3 are installed together from a rear end of the frame portion 11 into the accommodating chamber 111. Two buckling blocks 321 of each insulating blocks 32 respectively buckle and fit with the two buckling grooves 1111. Each terminal 31 is accommodated in a corresponding accommodating groove 125. The contact portion 311 of each terminal 31 enters the mating chamber 124.

Figure 5:
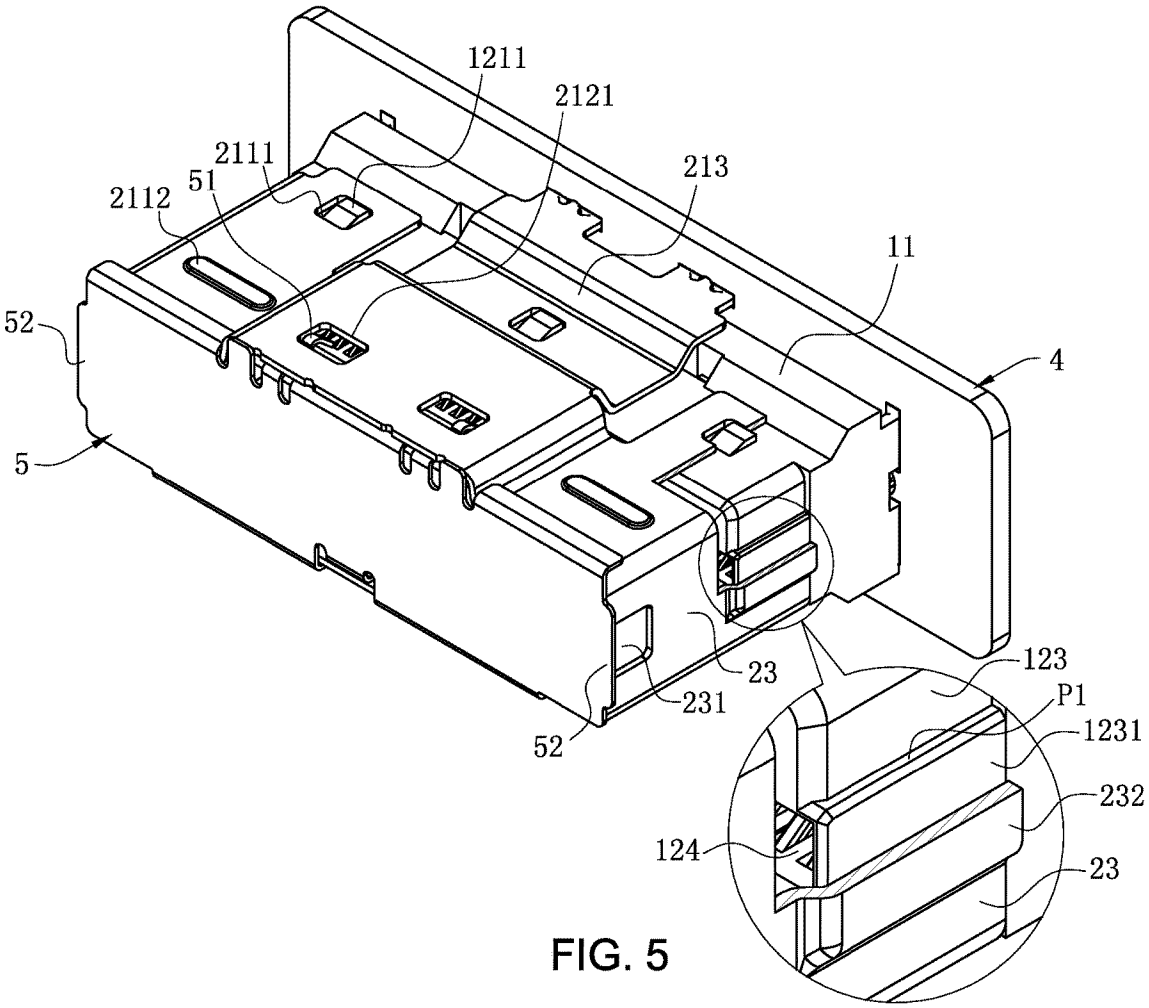
FIG. 5 is a perspective assembled schematic view of FIG. 4.
Figure 6:
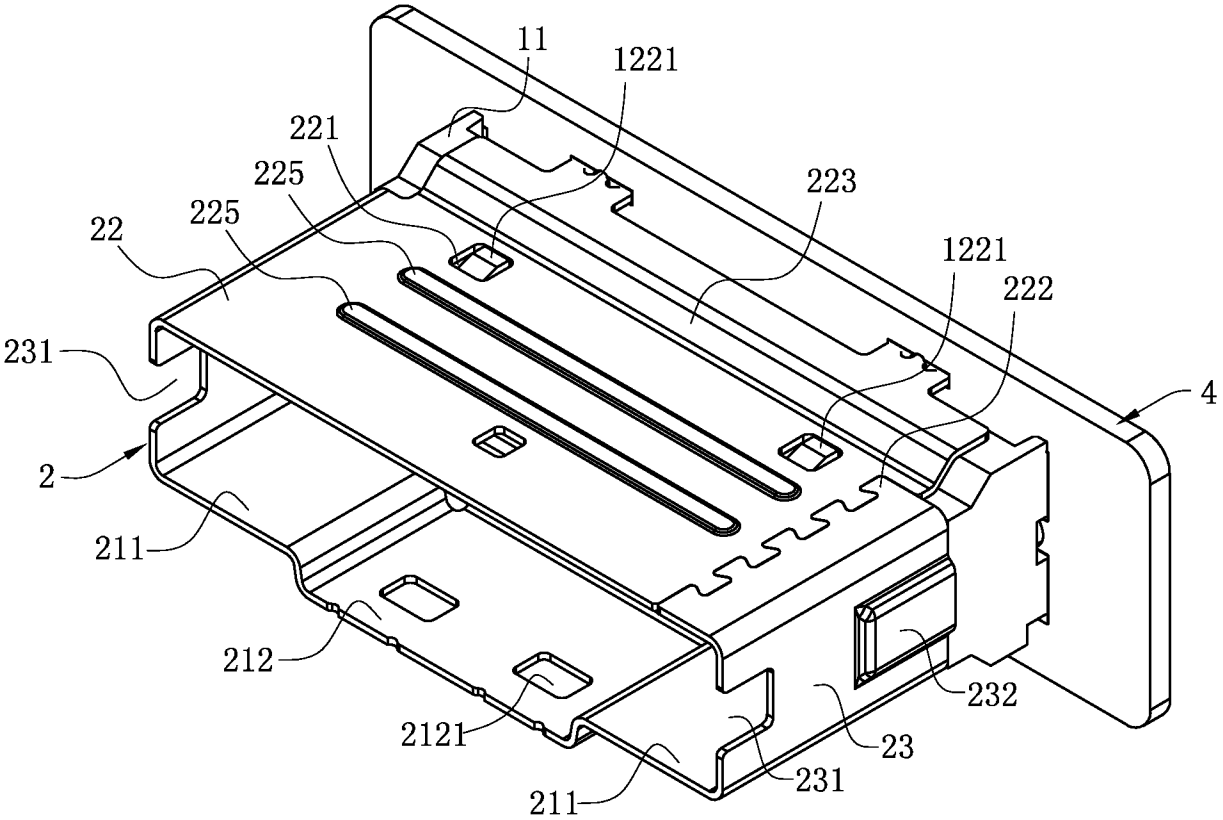
FIG. 6 is a schematic view of FIG. 5 being rotated for 180°.
Figure 10:
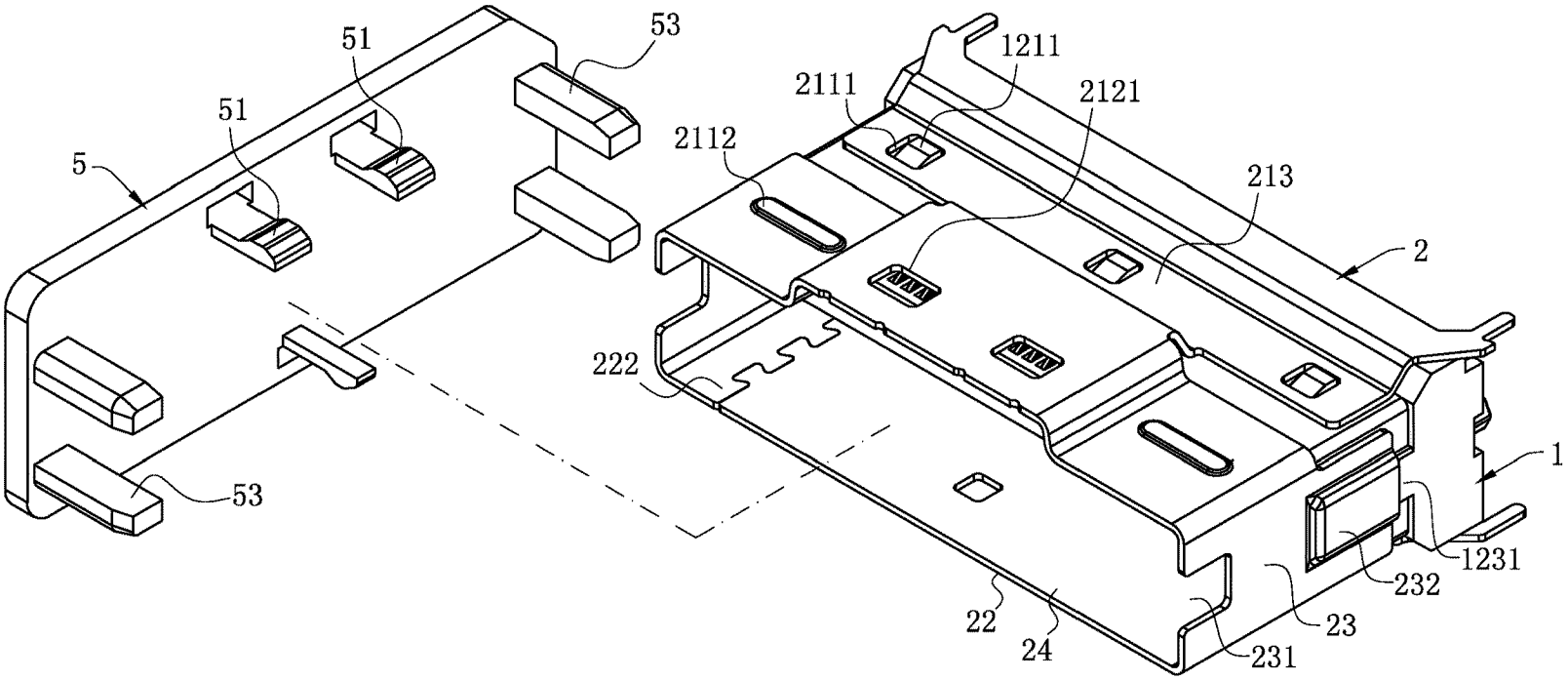
FIG. 10 is a schematic view of a dustproof cover and an electrical connector before being assembled according to another embodiment of the present invention.
Figure 11:
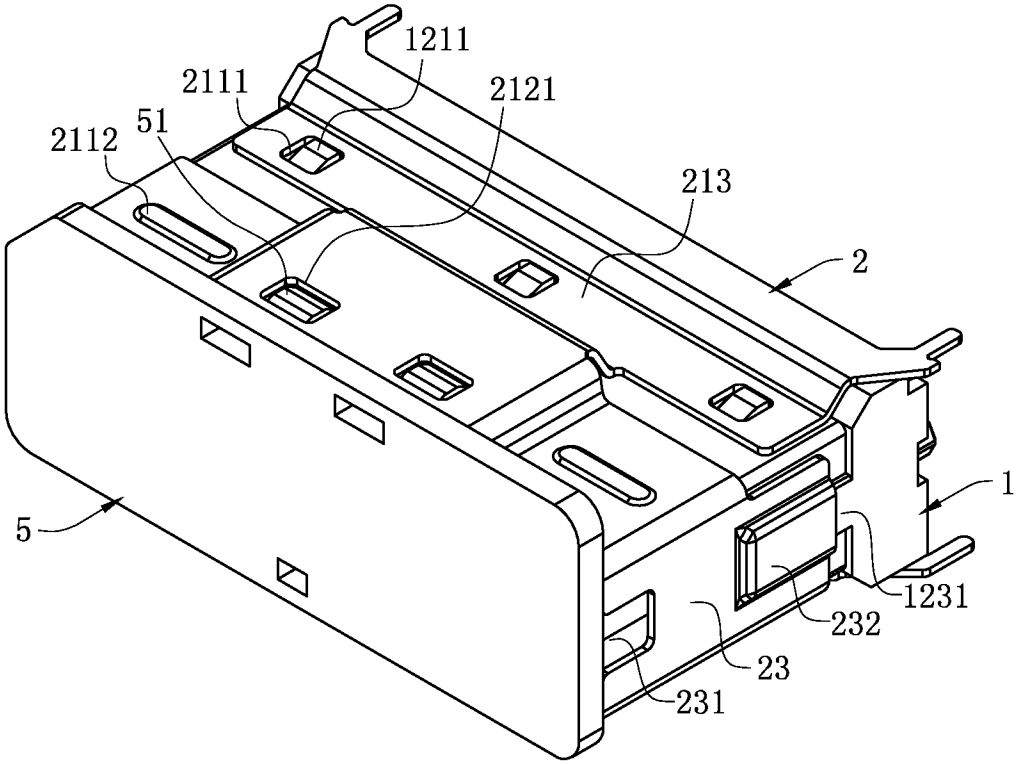
FIG. 11 is a schematic view of the dustproof cover and the electrical connector in FIG. 10 being assembled.

As shown in FIG. 3 to FIG. 5, the electrical connector further has a dustproof cover 5 to cover the mating port 24. In this embodiment, the dustproof cover 5 is made of a metal material. The dustproof cover 5 is provided with a buckling portion 51 to be buckled in each of the buckling holes 2121, correspondingly. Each of two opposite sides of the dustproof cover 5 is protrudingly provided with a handgrip portion 52 right in front of the notch 231 and laterally protrudes out of the notch 231. As shown in FIG. 10 and FIG. 11, in another embodiment, the dustproof cover 5 is made of plastic. The dustproof cover 5 is provided with a buckling portion 51 to be buckled in each of the buckling holes 2121, correspondingly, and is provided with four positioning posts 53 respectively abutting four bending locations between the side walls 23, the top wall 21 and the bottom wall 22.

Figure 9:
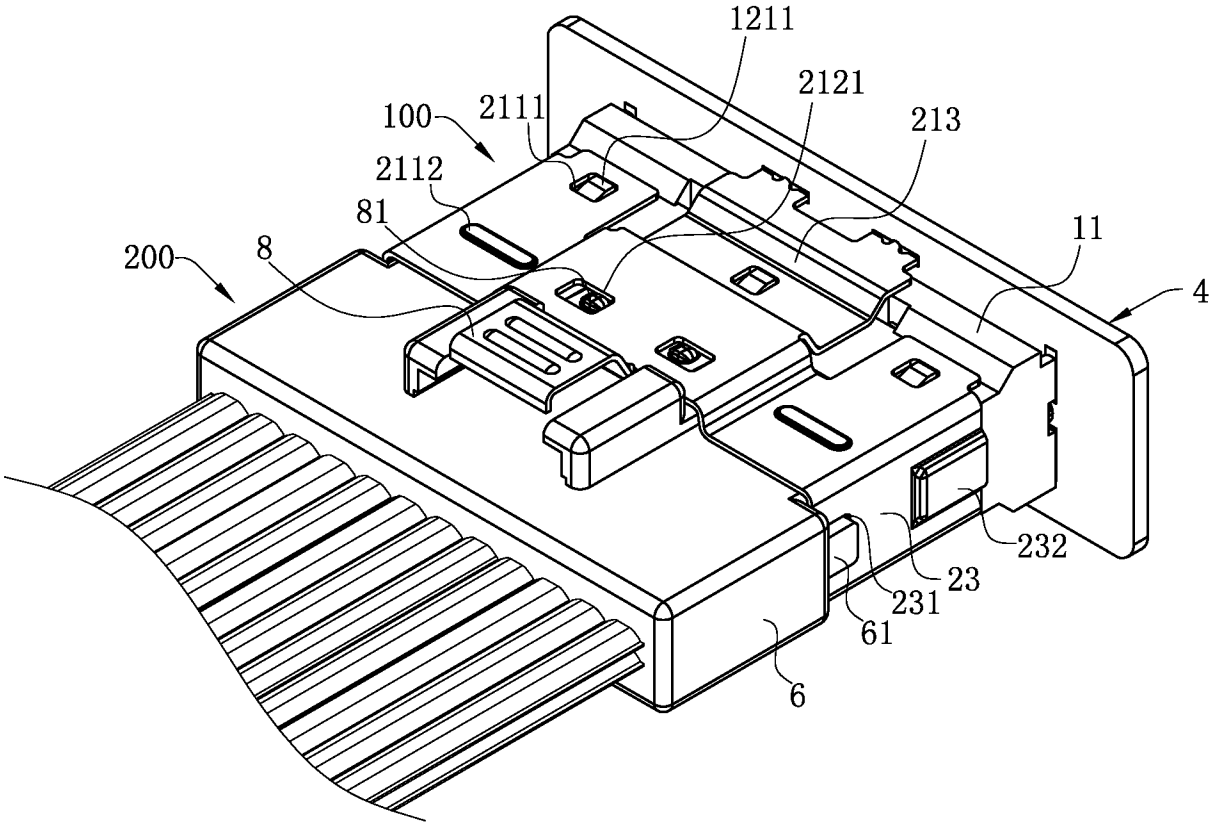
FIG. 9 is a schematic view of an electrical connector after being mated with a mating connector.

As shown in FIG. 8 and FIG. 9, the mating connector 200 includes a body portion 6, an insertion portion 7 provided at a rear end of the body portion 6, and a latching member 8 installed on the body portion 6. Two opposite sides of the body portion 6 are respectively provided with a positioning block 61. The positioning blocks 61 are configured to fit with the notches 231, so as to fix the electrical connector 100 and the mating connector 200. The insertion portion 7 is provided with multiple gold fingers 71 that are configured to conductively connect the contact portions 311. Two latching portions 81 protrude from the latching member 8. The latching portions 81 are configured to latch with the buckling holes 2121, so as to fix the electrical connector 100 and the mating connector 200. In certain embodiments of the present invention, the buckling holes 2121 are used to buckle one of the buckling portions 51 and the latching portions 81 when unbuckle the other of the buckling portions 51 and the latching portions 81.

In conclusion, the electrical connector according to certain embodiments of the present invention has the following beneficial effects.

(1) A projection 1231 is protrudingly provided outward from the outer surface of each of the side plates 123 of the insulating body 1. The highest point P1 of the projection 1231 is higher than the mating chamber 124, and the lowest point P2 of the projection 1231 is lower than the mating chamber 124. Further, each side wall 23 of the shielding shell 2 is respectively and correspondingly provided with a fitting portion 232 to fit with the projection 1231. Therefore, the strength of the side plates 123 is improved, and scratches and damages caused to the side plates 123 due to inaccurate alignment of the insertion portion 7 of the mating connector 200 may be reduced efficiently, thereby improving service life of the electrical connector 100, and enabling the electrical connector 100 to better meet requirements of users.

(2) The front end of the projection 1231 is flush with the front end of the top plate 121. The front end of the mating chamber 124 has a guide chamfer 126 extending to the front end of the projection 1231. The guide chamfer 126 provides a guiding function. Therefore, the insertion portion 7 of the mating connector 200 may be guided to enter the mating chamber 124 of the insulating body 1 by the guide chamfer 126, thereby reducing the scratches and damages caused to the insulating body 1 due to inaccurate alignment of the insertion portion 7.

(3) Each of the side plates 123 of the base portion 12 is further provided with an abutting portion 1232 connected to the rear end of the projection 1231, thereby further improving strength of the projection 1231, so as to improve the service life of the electrical connector 100.

(4) The side walls 23 are connected to the top wall 21 and the bottom wall 22 to form a totally enclosed structure, which may improve strength of the mating port 24 of the shielding shell 2. The top wall 21 is provided with the first through hole 2111 engaged with the first engaging block 1211 of the top plate 121. The bottom wall 22 is provided with the second through holes 221 engaged with the second engaging block 1221 of the bottom plate 122. Therefore, engagement strength of the shielding shell 2 and the insulating body 1 may be enhanced, so as to efficiently avoid impacts on a mating performance of the electrical connector 100 and the mating connector 200 because the shielding shell 2 is loosened.

(5) The front end of each side wall 23 is provided with a notch 231. Each of two opposite sides of the dustproof cover 5 is protrudingly provided with a handgrip portion 52 right in front of the notch 231 and laterally protrudes out of the notch 231. The handgrip portion 52 may facilitate the user to take out the dustproof cover 5.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector electrically connected to a mating connector, comprising:

an insulating body having a base portion, wherein the base portion comprises a mating chamber enclosed by a top plate, a bottom plate and two side plates, the top plate and the bottom plate are located opposite to each other in a vertical direction, the mating chamber is configured for an insertion portion of the mating connector to insert backward therein, the top plate and the bottom plate are respectively provided with a plurality of accommodating grooves, the accommodating grooves communicate with the mating chamber, an outer surface of each of the two side plates is provided with a projection, a highest point of the projection in the vertical direction is higher than the mating chamber, and a lowest point of the projection in the vertical direction is lower than the mating chamber;

a plurality of terminals, correspondingly accommodated in the accommodating grooves; and a shielding shell, having a top wall and two opposite side walls formed by bending downward from two opposite sides of the top wall, wherein a mating port is enclosed by the top wall and front ends of the two side walls and located in front of the projection, the mating port is larger than the mating chamber, the top wall shields the top plate and at least partially protrudes forward from the top plate, each of the two side walls shields a corresponding one of the two side plates and at least partially protrudes forward from the corresponding one of the two side plates, each of the two side walls is respectively and correspondingly provided with a fitting portion to fit with the projection, and the fitting portion is formed by protruding outward from an outer surface of each of the two side walls, and wraps the projection.

2. The electrical connector according to claim 1, wherein a front end of the projection is flush with a front end of the top plate, a front end of the mating chamber has a guide chamfer, and the guide chamfer extends to the front end of the projection.

3. The electrical connector according to claim 1, wherein a frame portion extends backwardly from the base portion, an upper surface of the frame portion is higher than the top plate, the top wall backward abuts a front end of the frame portion, and a surface of the projection is flush with a side surface of the frame portion.

4. The electrical connector according to claim 1, wherein an abutting portion is connected to a rear end of the projection, and each of the two side walls backwardly abuts the abutting portion respectively and correspondingly.

5. The electrical connector according to claim 1, wherein the insulating body is protrudingly provided with two installation portions installed in two installation holes of a circuit board, one of the two installation portions is rhombic and the other of the two installation portions is cylindrical, a side edge of the insulating body is provided with a groove extending to one of the installation portions, and a gap distance exists between an edge of the one of the installation portions and the side edge of the insulating body.

6. The electrical connector according to claim 1, wherein the top wall has two side portions and a protruding portion located between the two side portions, the protruding portion has a buckling hole for latching the mating connector, the two side portions are provided with two ribs protruding upward and located at two opposite sides of the protruding portion, and the two ribs are located in front of the top plate.

7. The electrical connector according to claim 6, wherein the top wall is provided with two first through holes located right behind the two ribs, and the insulating body is provided with two first engaging blocks engaged with the two first through holes respectively.

8. The electrical connector according to claim 7, wherein the shielding shell further has a bottom wall provided to be opposite to the top wall, the bottom wall is provided with two second through holes, the insulating body is provided with two second engaging blocks engaged with the two second through holes respectively, and the two second through holes are located between the two first through holes in a transverse direction.

9. The electrical connector according to claim 7, wherein the shielding shell further has a bottom wall provided to be opposite to the top wall, a seam portion is formed on the bottom wall to fix the shielding shell after the shielding shell is bent, and the seam portion is at least partially aligned with one of the two first through holes in the vertical direction.

10. The electrical connector according to claim 1, wherein the top wall is provided with a buckling hole, a dustproof cover is provided to cover the mating port, the dustproof cover is provided with a buckling portion, and the buckling hole is used to buckle one of the buckling portion and the mating connector.

11. The electrical connector according to claim 10, wherein the front end of each of the two side walls is provided with a notch, and each of two opposite sides of the dustproof cover is protrudingly provided with a handgrip portion right in front of the notch and laterally extends beyond the notch in a transverse direction.

12. The electrical connector according to claim 10, wherein the shielding shell further has a bottom wall provided to be opposite to the top wall, and the dustproof cover is made of plastic and is provided with four positioning posts respectively abutting four bending locations between the side walls, the top wall and the bottom wall.

13. An electrical connector electrically connected to a mating connector, comprising:

an insulating body having a base portion, wherein the base portion comprises a mating chamber enclosed by a top plate, a bottom plate and two side plates, the top plate and the bottom plate are located opposite to each other in a vertical direction, the mating chamber is configured for an insertion portion of the mating connector to insert backward therein, a front end of the mating chamber has a guide chamfer, the top plate and the bottom plate are respectively provided with a plurality of accommodating grooves, the accommodating grooves communicate with the mating chamber, an outer surface of each of the two side plates is provided with a projection, a highest point of the projection in the vertical direction is higher than the mating chamber, a lowest point of the projection in the vertical direction is lower than the mating chamber, a front end of the projection is flush with a front end of the top plate, and the guide chamfer extends to the front end of the projection;

a plurality of terminals, correspondingly accommodated in the accommodating grooves; and a shielding shell, having a top wall and two opposite side walls formed by bending downward from two opposite sides of the top wall, wherein a mating port is enclosed by the top wall and front ends of the two side walls and located in front of the projection, the mating port is larger than the mating chamber, the top wall shields the top plate and at least partially protrudes forward from the top plate, each of the two side walls shields a corresponding one of the two side plates and at least partially protrudes forward from the corresponding one of the two side plates, and each of the two side walls is respectively and correspondingly provided with a fitting portion to fit with the projection.

14. The electrical connector according to claim 13, wherein a frame portion extends backwardly from the base portion, an upper surface of the frame portion is higher than the top plate, the top wall backward abuts a front end of the frame portion, and a surface of the projection is flush with a side surface of the frame portion.

15. The electrical connector according to claim 13, wherein the top wall has two side portions and a protruding portion located between the two side portions, the protruding portion has a buckling hole for latching the mating connector, the two side portions are provided with two ribs protruding upward and located at two opposite sides of the protruding portion, and the two ribs are located in front of the top plate.

16. An electrical connector electrically connected to a mating connector, comprising:

an insulating body having a base portion, wherein the base portion comprises a mating chamber enclosed by a top plate, a bottom plate and two side plates, the top plate and the bottom plate are located opposite to each other in a vertical direction, the mating chamber is configured for an insertion portion of the mating connector to insert backward therein, the top plate and the bottom plate are respectively provided with a plurality of accommodating grooves, the accommodating grooves communicate with the mating chamber, an outer surface of each of the two side plates is provided with a projection, a highest point of the projection in the vertical direction is higher than the mating chamber, an abutting portion is connected to a rear end of the projection, and a lowest point of the projection in the vertical direction is lower than the mating chamber;

a plurality of terminals, correspondingly accommodated in the accommodating grooves; and a shielding shell, having a top wall and two opposite side walls formed by bending downward from two opposite sides of the top wall, wherein a mating port is enclosed by the top wall and front ends of the two side walls and located in front of the projection, the mating port is larger than the mating chamber, the top wall shields the top plate and at least partially protrudes forward from the top plate, each of the two side walls shields a corresponding one of the two side plates and at least partially protrudes forward from the corresponding one of the two side plates, each of the two side walls backwardly abuts the abutting portion respectively and correspondingly, and each of the two side walls is respectively and correspondingly provided with a fitting portion to fit with the projection.

17. The electrical connector according to claim 16, wherein a front end of the projection is flush with a front end of the top plate, a front end of the mating chamber has a guide chamfer, and the guide chamfer extends to the front end of the projection.

18. The electrical connector according to claim 16, wherein a frame portion extends backwardly from the base portion, an upper surface of the frame portion is higher than the top plate, the top wall backward abuts a front end of the frame portion, and a surface of the projection is flush with a side surface of the frame portion.

19. The electrical connector according to claim 16, wherein the top wall has two side portions and a protruding portion located between the two side portions, the protruding portion has a buckling hole for latching the mating connector, the two side portions are provided with two ribs protruding upward and located at two opposite sides of the protruding portion, and the two ribs are located in front of the top plate.

20. The electrical connector according to claim 16, wherein the insulating body is protrudingly provided with two installation portions installed in two installation holes of a circuit board, one of the two installation portions is rhombic and the other of the two installation portions is cylindrical, a side edge of the insulating body is provided with a groove extending to one of the installation portions, and a gap distance exists between an edge of the one of the installation portions and the side edge of the insulating body.

* * * * *